United States Patent [19]

Bragg

[11] 3,946,572

[45] Mar. 30, 1976

[54] APPARATUS FOR TRANSFERRING CRYOGENIC LIQUID FROM ONE DEWAR TO ANOTHER

[75] Inventor: Kenneth R. Bragg, Redondo Beach, Calif.

[73] Assignee: Parker-Hannifin Corporation, Cleveland, Ohio

[22] Filed: Sept. 26, 1974

[21] Appl. No.: 509,677

[52] U.S. Cl. ..... 62/50; 62/55; 141/82

[51] Int. Cl.[2] ..... F17C 7/02

[58] Field of Search ..... 62/54, 55, 49, 50, 51; 141/82

[56] References Cited

UNITED STATES PATENTS

| | | | |
|---|---|---|---|
| 3,109,293 | 11/1963 | Williams et al. | 62/55 |
| 3,191,395 | 6/1965 | Maher et al. | 62/54 |
| 3,211,191 | 10/1965 | Honisch | 62/49 X |
| 3,456,451 | 7/1969 | Roberson, Jr. | 62/55 |
| 3,633,372 | 1/1972 | Kimmel et al. | 62/49 |

*Primary Examiner*—Carroll B. Dority, Jr.
*Assistant Examiner*—Ronald C. Capossela
*Attorney, Agent, or Firm*—John N. Wolfram

[57] ABSTRACT

This invention relates to an apparatus for transferring a cryogenic fluid from one dewar to another and is characterized in that it provides a means for equalizing the temperatures in the liquid and vapor spaces of the supply dewar whereby the pressure in the dewar may be utilized for accurate control, either manual or automatic, of the amount of heat that must be added to the cryogenic liquid supplied to the receiving dewar for obtaining the desired receiving dewar pressure with minimum addition of heat to the supply dewar and no loss of cryogenic fluid through overboard vents during the transferring process. The apparatus has particular application as a ground servicing unit for filling liquid nitrogen dewars in aircraft.

17 Claims, 2 Drawing Figures

APPARATUS FOR TRANSFERRING CRYOGENIC LIQUID FROM ONE DEWAR TO ANOTHER

BACKGROUND OF THE INVENTION

Some aircraft are now fitted with an inerting system in which gaseous nitrogen ($GN_2$) is supplied to the fuel tanks for diluting the oxygen content therein to prevent explosion or combustion of fuel vapor within the tanks. The supply of nitrogen is carried on board in liquid form ($LN_2$) within a dewar which must be refilled from a supply dewar from time to time under conditions and in a manner so that the $LN_2$ will boil at a predetermined pressure, such as 65 PSIA, for proper supply to the aircraft inerting system. Prior methods and apparatus for filling the aircraft dewars have not been entirely satisfactory because of complexity and also because during the filling process nitrogen is lost to atmosphere through overboard vents and an excessive amount of heat is added to the $LN_2$ remaining in the supply dewar.

Because boiling pressure of $LN_2$ in a supply dewar should be lower than that in a dewar to be filled, it is the practice to deliver $LN_2$ to an airport main supply dewar at a boiling pressure of about 15 PSIA, at which the temperature is about −320°F (−195°C), for ultimate use in filling the aircraft dewars to the required boiling pressure of 65 PSIA, at which the temperature is about −290°F (−178°C). The stored $LN_2$ gradually gains heat from its surroundings so that both the temperature and boiling pressure rise. However, the airport main supply is quite large so that the temperature and pressure rise is very gradual.

From the main airport supply, $LN_2$ is first transferred to a dewar in a vehicle referred to as a ground servicing unit (GSU), which may hold enough $LN_2$ to fill eight or ten aircraft dewars. When freshly filled a GSU dewar will contain the $LN_2$ fairly close to 15 PSIA. Then when the $LN_2$ from the GSU dewar is transferred to an aircraft dewar heat must be added to the transferred fluid to bring the boiling pressure up to 65 PSIA. Any excess heat added to the $LN_2$ returns to the GSU dewar during the filling process and thus needlessly raising its temperature and boiling pressure. Because of this returned heat and the heat that is constantly being absorbed from its surroundings, the temperature of $LN_2$ in a GSU dewar may vary considerably from one filling of an aircraft dewar to another. Consequently, the amount of heat to be added during one filling operation can vary considerably from that to be added in a different filling operation.

One might expect the vapor pressure in the GSU dewar ullage to coincide with the boiling pressure of the $LN_2$ therein and be a measure of the heat in the $LN_2$. However, under quiescent conditions heat that has entered the dewar tends to stratify in the ullage so that a reading of ullage pressure in present systems is not a true measure of the heat in the $LN_2$ and therefore is not a reliable indicator for determining how much heat to add during the filling operation.

SUMMARY OF THE INVENTION

The present invention provides for the equalizing of the temperatures of the $GN_2$ and $LN_2$ within a GSU dewar by spraying some of the liquid into the vapor space whereby the ullage pressure is a true indication of the temperature of the $LN_2$, measuring the ullage pressure, and setting a flow divider valve in a delivery conduit to correspond with the measured pressure whereby the flow divider valve will divert a portion of the $LN_2$ being transferred to the aircraft dewar to a heat exchanger for adding just enough heat so that the boiling pressure of the transferred $LN_2$ will be the desired 65 PSIA. The invention further provides for recirculating some of the $LN_2$ through a separate heater in the event the heat exchanger has not added the required amount of heat to the transferred $LN_2$.

The flow divider valve has indicia thereon for setting the valve to positions corresponding with the ullage pressure readings. Also, the valve may be directly responsive to the ullage pressure for achieving its corresponding position and it may have a manual override for manual setting to the proper position.

DETAIL DESCRIPTION

Figure 1:
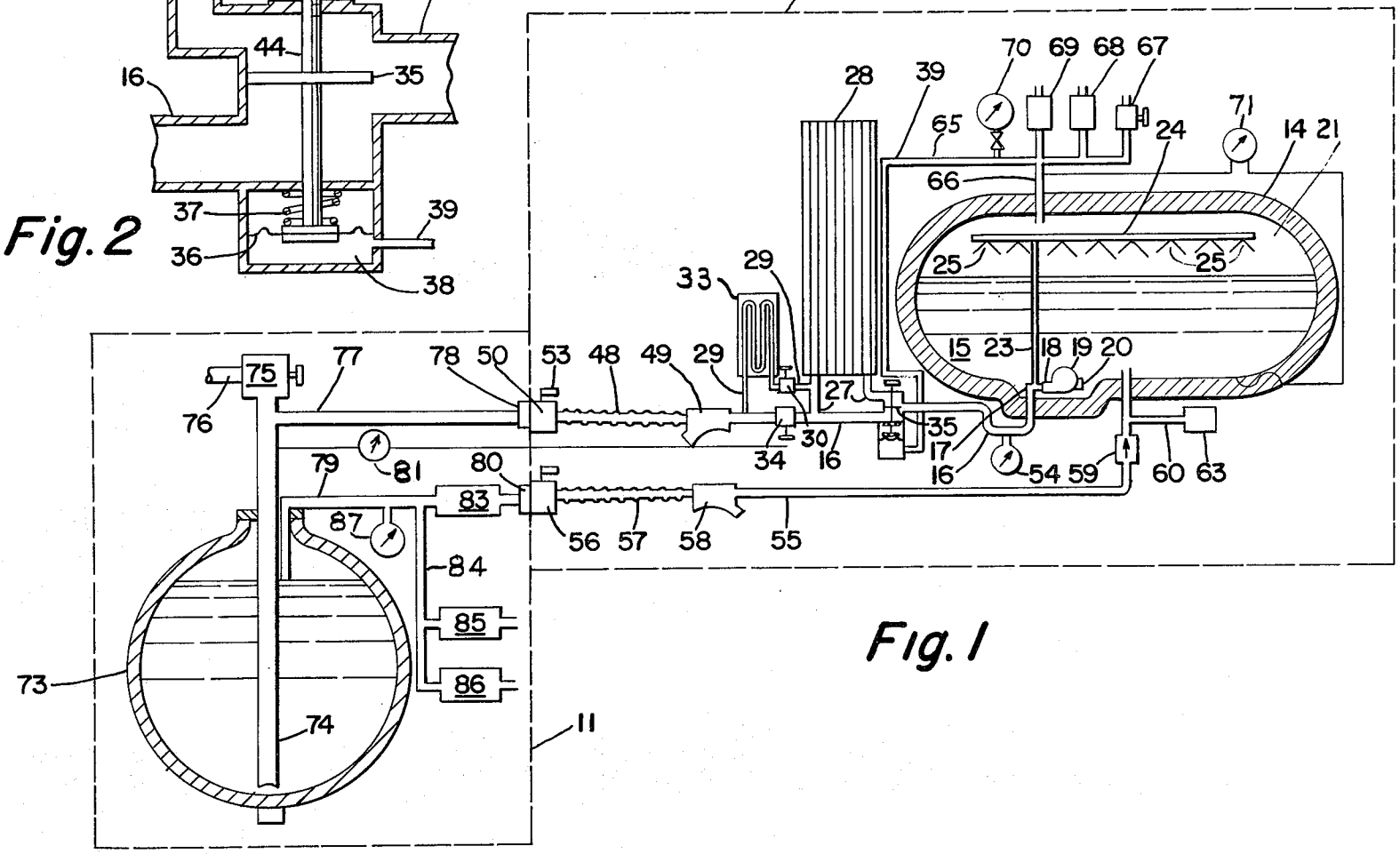
FIG. 1 is a schematic diagram of a filling system comprising a supply dewar and a receiving dewar and the apparatus of the present invention.
Figure 2:
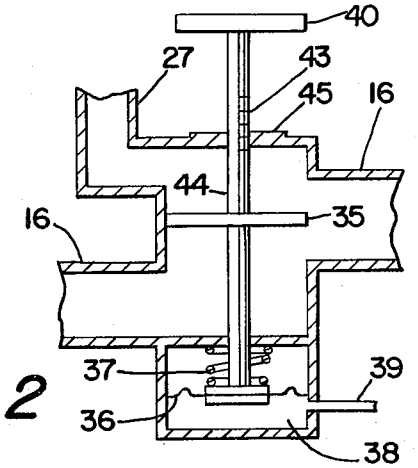
FIG. 2 is a schematic illustration of a flow divider valve with indicia thereon for assisting in making a proper setting of the valve.

The system as illustrated in FIG. 1 includes a ground supply unit (GSU) that includes the items shown within the dotted outline 10 and which may be installed on a ground vehicle for use at airports. The items contained within the dotted outline 11 are part of an installation in an aircraft. The GSU includes a dewar 14 containing a supply of liquid nitrogen 15 at its lower portion and providing a vapor space 21 at its upper portion. Passing through a lower wall of the dewar 14 is a main supply conduit 16 of relatively large flow capacity and whose inner end 17 communicates with the discharge outlet 18 of an electrically driven pump 19 having an intake port 20. The inner end 17 of the main conduit also communicates with a circulating tube 23 of smaller flow capacity than the main conduit 16 and whose upper end communicates with a spray bar 24 located in vapor space 21 and having a series of openings, or nozzles, 25.

Exteriorly of dewar 14, main conduit 16 has a conduit 27 branching therefrom which goes through a heat exchanger 28 that draws heat from ambient air. Branch conduit 27 then reconnects to main conduit 16. Connected to the downstream end of branch conduit 27 is a further branch conduit 29 having a valve 30 for controlling the flow therethrough. Such further branch conduit 29 passes through a heater 33 and then connects to main conduit 16 downstream of a shutoff valve 34 in the latter and which in turn is downstream of the reconnection of branch conduit 27 with conduit 16. Mounted within main conduit 16 at its juncture with the upstream end of branch conduit 27 is a flow dividing valve 35 settable to various positions for diverting a portion of the upstream flow in main conduit 16 into branch conduit 27. Valve 35 may be adjusted either by means of a pressure responsive diaphragm 36 that is pressed by a spring 37 toward a position for increasing the amount of flow diverted to branch conduit 27 and which is movable by fluid pressure in a chamber 38 in a direction for decreasing the amount of flow into branch conduit 27. Chamber 38 communicates by way of a tubing line 39 with the interior of dewar 14 so that the pressure therein corresponds with the ullage pressure in the dewar. Valve 35 may also be adjusted manually by way of a handle 40 for overriding the adjustment provided by diaphragm 36. Indicia markings 43 may also be provided on the valve 35, as for example, by way of markings on stem 44, which in combination with some reference point or marking on a portion 45 of the valve body may indicate the desired adjusted position of the valve 35 to correspond with given ullage pressures within dewar 14. These markings 43 may thus be used either for making a manual setting by way of handle 40 or by way of monitoring operation of the valve by diaphragm 36.

Main conduit 16 may also include a flexible hose portion 48 having its upstream end connected to a filter 49 and its downstream end to an inlet half 50 of a quick disconnect type coupling having a shutoff valve therein manually operable by a handle 53. Main conduit 16 may also have a pressure gauge 54 connected thereto upstream of flow divider valve 35.

Also communicating with the interior of dewar 14 is a return line 55 having another coupling half 56 at its upstream end, and including a hose portion 57, a filter 58, a check valve 59 and a branch line 60 to which is attached a fill and drain coupling 63.

A manifold 65 is connected to the interior of the dewar 14 by a tube 66 and communicates with a manually operable ullage pressure relief valve 67, a pair of automatic relief valves 68, 69, a pressure gauge 70 and with a line 39. A capacitance type gauge may be utilized for checking the liquid level in dewar 14.

The receiving unit 11 includes the receiving dewar 73. Leading from the dewar is a stand pipe 74 to which is connected a valve 75 to control dispensing of liquid nitrogen to the aircraft inerting system via a conduit 76. Also connected to stand pipe 74 is a fill conduit 77 having a coupling half 78 connectable to coupling half 50. Associated with pipe 74 is an electrical capacitance type gauge 81 that measures the level of $LN_2$ in dewar 73 and causes valve 34 to shut when the $LN_2$ in dewar 73 has reached a predetermined level.

A return line 79 extends into dewar 73 and has a coupling half 80 connectable to coupling half 56. There is also a back pressure relief valve 83 and upstream of the latter a branch conduit 84 connects with conduit 79 and which communicates with a pair of pressure relief valves 85, 86. There is also a pressure gauge 87 connected to conduit 79.

OPERATION

When aircraft dewar 73 is to be filled, coupling halves 50, 56 are connected respectively to halves 78, 80 and the coupling valves therein are opened. At this time the temperature and boiling pressure of the liquid nitrogen in supply dewar 14 may be different than when a previous filling operation was started, depending upon how much heat has been added to the liquid nitrogen supply 15 during the last filling operation and from the supply dewar's surroundings since that time. Moreover, the ullage pressure within space 21 as registered upon gauge 70 may not be a true indication of the boiling pressure and corresponding temperature of the liquid nitrogen because heat may have become stratified in vapor space 21.

To equalize the ullage temperature and to make it the same as that of the liquid, pump 19 is turned on before valve 34 is opened. This causes the full discharge from pump 19 to enter tube 23 and spray bar 24 from which it is sprayed into the tank ullage. This cools the nitrogen gas in the ullage to the temperature of the liquid nitrogen. This also causes a change in the ullage pressure so that it is a true indication of the boiling pressure of the liquid nitrogen in dewar 14. The ullage pressure will now be reflected in chamber 38 of the flow divider valve 35 and cause pressure responsive diaphragm 36 to move valve 35 to a position corresponding to the dewar ullage pressure for diverting a predetermined flow from main conduit 16 to branch conduit 27. The indicia 43 on valve stem 44 are preferably in PSIA readings so that when gauge 70 indicates a particular PSIA reading the corresponding PSIA marking 43 will be in register with a reference mark or surface on valve body 45. Thus, the indicia 43 can be used for monitoring operation of valve by diaphragm 36. In the event diaphragm 36 malfunctions, handle 40 provides a manual override so that the valve can be manually adjusted to its proper position by reference to the pressure reading on gauge 70 and utilization of the indicia 43. In some cases it may even be desirable to omit automatic positioning of valve 35 by not providing the pressure responsive diaphragm 36 but to rely only upon a manual setting through the use of handle 40.

After flow divider valve 35 has been properly positioned, valve 34 is opened, either by manual or electric operation, as desired. Liquid nitrogen being discharged by pump 19 now flows through main conduit 16 and even though the latter is of larger flow capacity than line 23, some liquid nitrogen will continue to flow into spray bar 24 and be sprayed therefrom.

As liquid nitrogen enters the relatively warm conduits 16 and 27 it flashes into vapor in which form it initially enters dewar 73 through pipe 74, the latter being open at its bottom end. This quickly builds up pressure in the aircraft dewar 73 to the cracking pressure of back pressure relief valve 83. Such cracking pressure may, for example, be about 50 PSIG. Vapor from dewar 73 then flows through vent lines 79, 55 back to supply dewar 14 where it rises to vapor space 21 and is recondensed to liquid by the liquid nitrogen being sprayed into the vapor space and is thus prevented from building up pressure in the supply dewar.

When the fill conduits have been sufficiently chilled, the liquid nitrogen passing therethrough will cease to vaporize and dewar 73 will start filling with liquid nitrogen. When liquid level gauge 81 indicates that the dewar is full, it will also automatically cause valve 34 to close. If valve 34 should fail to close, liquid nitrogen will overflow through vent lines 79, 55 to dewar 14 with no consequence other than unnecessarily adding heat to the liquid nitrogen supply 15 in the supply dewar. Under these conditions the vent coupling halves 56, 80 will frost and the operator will know that he should manually close valve 34.

Upon opening of valve 34 to start the filling operation, some of the nitrogen in the upstream portion of main conduit 16 will be diverted by valve 35 into branch conduit 27 where it enters heat exchanger 28 for adding heat thereto before it is returned to conduit 16 just upstream of valve 34. If valve 35 has been properly positioned according to the pressure in dewar 14, there will be just enough heat added by the heat exchanger 28 to bring the temperature of the liquid nitrogen being discharged into dewar 73 to about −290°F (−178°C) with a corresponding boiling pressure of 65 PSIA.

After dewar 73 is filled and the filling operation stopped by closing of valve 34, pump 19 is shut off and coupling halves 50, 56 are disconnected from coupling halves 78, 80. The pressure in dewar 73 is then noted on gauge 87. If the pressure is less than 65 PSIA, it will be an indication that flow divider valve 35 had been improperly set. Coupling halves 50, 56 are then reconnected to halves 78 and 80, flow divider valve 35 is set manually to a position for closing off bypass conduit 27, and manual valve 30 opened. Pump 19 is then turned on again and, because of the relatively small flow capacity of line 29, a limited flow rate of nitrogen to dewar 73 is established. Heater 33 then causes the nitrogen flowing through line 29 to become vaporized and the vapor is delivered to dewar 73 where it will add heat to the liquid nitrogen therein until its boiling pressure is brought up to 65 PSIA, at which time valve 30 and pump 19 are to be shut off.

If during the regular filling operation flow divider valve 35 has been improperly set so that more nitrogen than necessary has been diverted into branch conduit 27 and heat exchanger 28, the only consequence will be that the extra heat will be deposited in the liquid nitrogen in dewar 14 so that the temperature thereof has been unnecessarily raised during the fill operation.

As previously mentioned, a major objective is to avoid waste of nitrogen by overboard venting of the GSU dewars 14 or the main airport liquid nitrogen storage tank, not shown. Each time an aircraft dewar 73 is filled from a GSU dewar 14, the GSU dewar will take on some heat during the filling process. Also, as the GSU stands by between fillings, the liquid nitrogen 15 in dewar 14 will pick up some heat from its surroundings. To prevent the heat so added from raising the temperature of the liquid nitrogen 15 in the GSU dewar to the point where its boiling pressure becomes 65 PSIA, after which it would vent to atmosphere, the GSU dewar 14 should be designed to handle the normal heat accumulation before it becomes empty and needs refilling from the airport main storage tank. Under such conditions there would normally be no loss of nitrogen from the GSU dewar to atmosphere.

However, if the boiling pressure within a particular GSU dewar approaches 65 PSIA, either because of an abnormally long standby period or because of some other abnormal condition, the liquid nitrogen therein should be returned to the airport main storage tank. Because the capacity of the latter is large compared to that of the GSU dewars, the increment of heat added to the main storage tank will be relatively small and will not raise the boiling pressure to the point where vent to atmosphere occurs.

Likewise, when a GSU dewar is being refilled from the airport main storage tank there will be a small increment of heat added to the liquid nitrogen in the storage tank but again it will not be enough to raise the boiling temperature within the tank through the normal number of GSU refillings that can be accomplished before the main storage tank must be replenished.

Thus, when the main storage tank and the GSU units for the particular airport are properly planned, there should be no occasion to lose nitrogen to atmosphere from either the aircraft dewar, the GSU dewars or the main storage tank and by the use of the GSU apparatus herein disclosed, the addition of heat to the liquid nitrogen during aircraft dewar filling operations can be minimized so that more filling operations and/or standby time can be accommodated by the GSU dewars than otherwise.

I claim:

1. Apparatus for filling a first dewar with a liquid, said apparatus comprising a second dewar having a lower portion adapted to contain a supply of the liquid and having an upper portion to provide a vapor space above the liquid supply, means entirely within the second dewar for circulating liquid from the lower portion to the upper portion for equalizing temperatures in said upper and lower portions, said circulating means including a conduit connected to the discharge side of a pump, said pump having its intake communicating with said lower portion, conduit means also connected to the discharge side of the said pump and having means thereon for connection to the first dewar whereby liquid may be delivered from the second dewar through the conduit to the first dewar, and means associated with the conduit means for adding heat to the liquid therein.

2. Apparatus in accordance with claim 1 in which said conduit continuously connects the discharge side of the pump to said upper portion.

3. The apparatus of claim 2 in which said conduit has a lesser flow capacity than said conduit means.

4. Apparatus for filling a first dewar with a liquid, said apparatus comprising a second dewar having a lower portion for containing a supply of the liquid and having an upper portion to provide a vapor space above the liquid supply, a main conduit leading from said lower portion to the exterior of the second dewar and having means thereon for connection to the first dewar, a branch conduit leading from the main conduit, a flow divider valve connected to one of the conduits and adjustable to a multiplicity of positions for varying flow of liquid through the main conduit and from the main conduit to the branch conduit, and means associated with the branch conduit for adding heat to the liquid therein.

5. Apparatus in accordance with claim 4 in which there is a pressure gauge exterior of the second dewar and operatively connected thereto for sensing fluid pressure within the second dewar, and said valve being settable to various positions for simultaneously varying flow of liquid into both the main and branch conduits in accordance with the pressure in the second dewar and said valve has indicia thereon to designate adjusted positions of the valve to correspond with pressures indicated by said gauge.

6. The apparatus of claim 4 in which said valve includes a pressure responsive member in pressure sensing communication with the interior of the second dewar and responsive to such sensed pressure for automatically adjusting the position of the valve in accordance with said sensed pressure.

7. The apparatus of claim 6 in which said valve includes a manually operable means for overriding said pressure responsive member in adjusting the position of the valve for further varying the flow in said main and branch conduits.

8. Apparatus for filling a first dewar with a liquid, said apparatus comprising a second dewar having a lower portion for containing a supply of the liquid and having an upper portion to provide a vapor space, a main conduit leading from said lower portion to the exterior of the second dewar, a branch conduit leading from the main conduit, a flow divider valve adjustable to various positions for varying flow of liquid from the main conduit to the branch conduit, means associated with the branch conduit for adding heat to liquid therein, said valve including a pressure responsive member in direct pressure sensing communication with the interior of the second dewar and responsive thereto for adjusting the position of the valve in accordance with said pressure.

9. The apparatus of claim 8 in which said valve includes a manual override for varying the adjusted position.

10. The apparatus of claim 8 in which said valve is spring pressed toward a position for increasing the flow through said branch conduit, and said pressure responsive member moves the valve in opposition to said spring for decreasing the flow through said branch conduit when pressure in the second dewar increases.

11. Apparatus for filling a first dewar with liquid, said apparatus comprising a second dewar having a lower portion for containing a supply of the liquid and having an upper portion to provide a vapor space, a main fill conduit leading from said lower portion to the exterior of the second dewar and having means thereon for connection to said first dewar, a branch conduit leading from the main conduit, a valve connected to one of the conduits and adjustable to various positions for controlling the amount of liquid passing from the main conduit to the branch conduit, means associated with the branch conduit for adding heat to liquid therein, and a vent conduit leading from the exterior of the second dewar to the interior thereof and having means thereon for connection to said first dewar and said vent conduit having a valve therein to provide for flow of fluid in only the direction toward the second dewar.

12. The apparatus of claim 11 in which said vent conduit has a branch line downstream of said valve for filling the second dewar.

13. Apparatus for filling a first dewar with liquid, said apparatus comprising a second dewar having a lower portion for containing a supply of said liquid and having an upper portion for containing vapor, a main fill conduit leading from said lower portion to the exterior of the second dewar, a branch conduit leading from the main conduit, a valve connected to one of the conduits and adjustable to various positions for controlling the amount of fluid passing from the main conduit to the branch conduit, means associated with the branch conduit for adding heat to the liquid therein, a pump having its intake communicating with said lower portion and having its discharge in communication with said main conduit, and a third conduit constantly communicating with the pump discharge and said upper portion, said third conduit including a series of spray openings in said upper portion.

14. Apparatus for filling a first dewar with a liquid, said apparatus comprising a second dewar having a lower portion for containing a supply of the liquid and having an upper portion to provide a vapor space above the liquid supply, a main conduit leading from said lower portion to the exterior of the second dewar, a branch conduit leading from a flow divider valve connected to said main conduit, said valve being adjustable to positions for varying flow of liquid from the main conduit to said branch conduit, a shut off valve in said main conduit downstream of said flow divider valve, and said branch conduit having a return connection to said main conduit between said flow divider valve and said shut off valve.

15. The apparatus of claim 14 in which there is a further conduit having one end communicating with said main and branch conduits upstream of said shut off valve and having its other end connected to said main conduit downstream of said shut off valve, and additional means associated with said further conduit for adding heat to liquid therein.

16. The apparatus of claim 15 in which there is a valve in said further conduit for controlling flow of fluid through said further conduit.

17. The apparatus of claim 15 in which said first mentioned heat adding means receives its heat from ambient air and said additional heat adding means receives its heat from a source other than ambient air.

* * * * *